US006313719B1

(12) United States Patent
Barnett et al.

(10) Patent No.: US 6,313,719 B1
(45) Date of Patent: Nov. 6, 2001

(54) METHOD OF TUNING A PLANAR FILTER WITH ADDITIONAL COUPLING CREATED BY BENT RESONATOR ELEMENTS

(75) Inventors: Ron Barnett, Santa Rosa, CA (US); Yee Leng Low, Berkeley Heights, NJ (US); Zhengxiang Ma, Summit, NJ (US); King L Tai, Berkeley Heights, NJ (US); Hui Wu, Union, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/522,450

(22) Filed: Mar. 9, 2000

(51) Int. Cl.[7] ..... H01P 1/203
(52) U.S. Cl. ..... 333/204; 333/202; 333/219
(58) Field of Search ..... 333/202, 204, 333/219, 110, 246, 205

(56) References Cited

U.S. PATENT DOCUMENTS

| | | | | |
|---|---|---|---|---|
| 2,968,012 | | 1/1961 | Alstadter | 333/205 |
| 3,644,850 | * | 2/1972 | Ho | 333/202 |
| 3,745,489 | * | 7/1973 | Cristal et al. | 333/204 |
| 5,990,765 | | 11/1999 | Mansour et al. | 333/204 |
| 5,990,766 | | 11/1999 | Zhang et al. | 333/205 |

FOREIGN PATENT DOCUMENTS

| | | | | |
|---|---|---|---|---|
| 0858121 A1 | | 8/1998 | (EP) . | |
| 0071508-A1 | * | 2/1983 | (EP) | 333/204 |

OTHER PUBLICATIONS

Oates, D.E. et al: "Superconducting Thin–Film YBA2CU307–X Resonators And Filters", May 29, 1991, Proceedings Of The Annual Symposium On Frequency Control, US, New York, IEEE, vol. SYMP. 45, pp. 460–466.
Takemoto, J.H. et al.: "High–TC Superconducting Microstrip Resonators And Filters On LAAI03", May 29, 1991, Proceedings Of The Annual Symposium On Frequency Control, US, New York, IEEE, vol. SYMP. 45, pp. 477–481.

* cited by examiner

*Primary Examiner*—Robert Pascal
*Assistant Examiner*—Stephen E. Jones
(74) *Attorney, Agent, or Firm*—David Volejnicek

(57) ABSTRACT

A bandpass planar filter (110) comprises a signal input and a signal output (116), and one or more resonator elements (112, 114) coupled serially end-to-end between the input and the output across gaps (118) that separate the elements from the input, the output, and from each other. The resonator elements form a serpentine shape such that at least two portions of the serpentine shape are positioned side-by-side parallel to each other separated by a spacing (120). The side-by-side portions effect additional coupling between the resonator elements that forms a notch (transmission zero) (204) in the passband (200) of the filter. The input, output, and resonator elements are etched into one surface (106) of a PC board (102); the other surface (104) of the PC board forms a ground plane of the filter, and the substrate (103) of the PC board forms a dielectric of the filter.

2 Claims, 4 Drawing Sheets

METHOD OF TUNING A PLANAR FILTER WITH ADDITIONAL COUPLING CREATED BY BENT RESONATOR ELEMENTS

TECHNICAL FIELD

This invention relates to electrical filters.

BACKGROUND OF THE INVENTION

Transmitter and/or receiver (henceforth referred to generically as "transceiver") technology has evolved over the decades from the use of wires, electro-mechanical components, and machined waveguide structures to the use of coax and thick film/thin film microstrip/stripline-based circuitry. But even with this evolution, the recent proliferation of, and resulting stiff competition among, wireless communications products have led to price/performance demands on transceivers that conventional technologies find difficult to meet. And some of the more expensive components of a transceiver are the "front end" filters.

Planar filters have been of interest to transceiver designers in recent years because of their relatively small size, low cost, and ease of manufacture. A planar filter is generally implemented using flat transmission-line structures, such as microstrip and stripline transmission lines separated from a ground plane by a dielectric layer. A typical implementation defines the planar filter as conductive traces on one side of a printed circuit (PC) board, defines the ground plane as a conductive layer on the other side of the PC board, and uses the laminate of the PC board for the dielectric. An illustrative example of such a planar filter is disclosed in U.S. Pat. No. 5,990,765.

Although the use of planar filters is advantageous, the planar-filter designs known to the inventors do not take sufficient advantage of the filter configuration and layout to maximize filter performance.

SUMMARY OF THE INVENTION

This invention is directed to solving these and other problems and disadvantages of the prior art. According to the invention, a filter of electrical signals comprises a signal input, a signal output, and one or more resonator elements coupled serially end-to-end between the input and the output across gaps that separate the one or more elements from the input, the output, and each other. Significantly, the one or more elements form a serpentine shape such that at least two portions of the serpentine shape are positioned side-by-side parallel to each other. The side-by-side portions effect additional coupling between the resonator elements. Preferably, the filter is a band pass filter, and the additional coupling forms a notch in the passband of the filter.

The invention provides a low-cost, high-performance filter, e.g., for radio frequency and microwave communications systems. It can be integrated with advanced packaging technology for no tuning and a better performance (steeper skirts on the filter passband) than conventional filter designs deliver, to achieve an overall improvement in transceiver performance.

These and other features and advantages of the invention will become more apparent from the following description of an illustrative embodiment of the invention considered together with the drawing.

DETAILED DESCRIPTION

Figure 1:
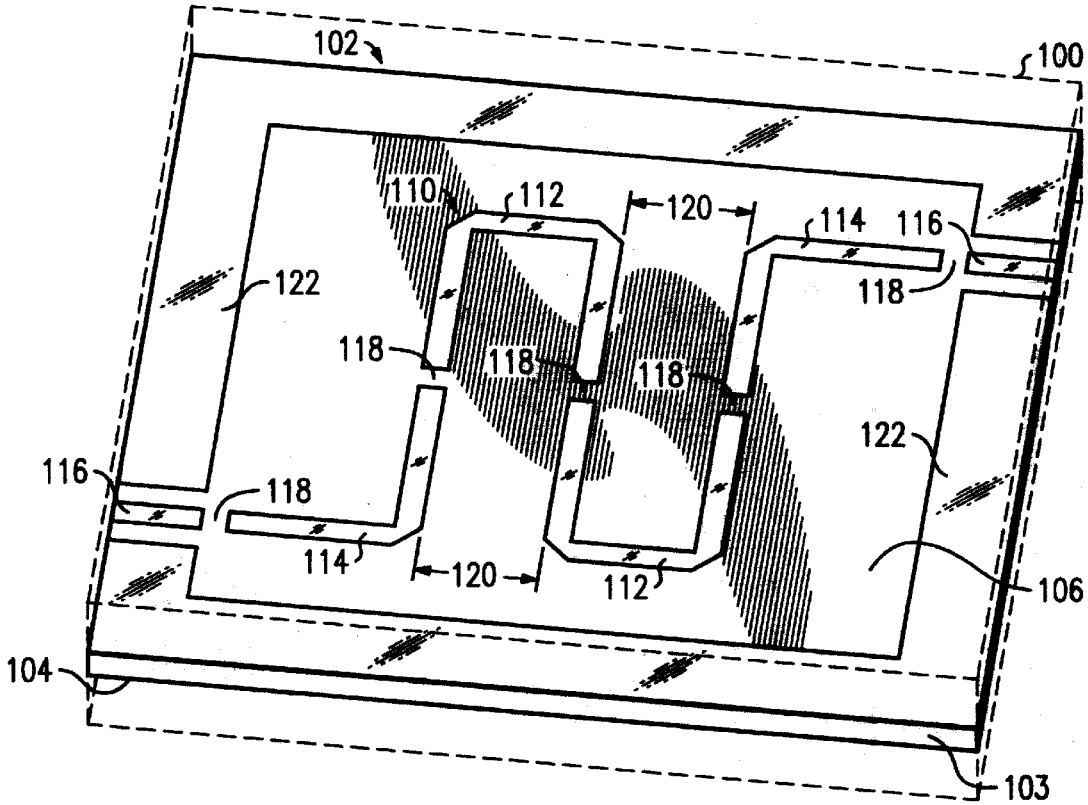
FIG. 1 is a perspective view of a four-pole planar filter that includes an illustrative embodiment of the invention.

FIG. 1 shows a planar filter assembly comprising a printed circuit (PC) board 102 mounted inside an electromagnetically isolating housing 100 (shown in dashed lines). PC board 102 forms a planar filter 110. A first surface 106 of PC board 102 defines resonator elements 112, 114 of filter 110. A second surface 104 of PC board 102 is coated with conductive material to define the ground plane of filter 110. And substrate 103 of PC board 102 defines the dielectric of filter 110. Resonator elements 112, 114 of filter 110 are surrounded by a ground fence 122 that extends around the periphery of PC board 102. Input and output connections to filter 110 are made by conductive traces 116 that extend through gaps in ground fence 122. Resonator elements 112, 114, ground fence 122, and traces 116 are illustratively chemically etched into a conductive coating of first surface 106 of PC board 102 by conventional techniques.

Planar filter 110 of FIG. 1 is a four-pole radiofrequency (RF) filter. It comprises four resonator elements 110, 114. Outer resonator elements 114 are "L" shaped, while inner resonator elements 112 are "U" shaped. Resonator elements 112, 114 are serially coupled to each other end-to-end across gaps 118 and together form a serpentine trace between input and output traces 116 to which they are also coupled across gaps 118, such that a plurality of segments of the trace are positioned side-by-side parallel to each other and are separated from each other by a spacing 120.

The number of poles of the filter is determined by, and equals, the number of resonator elements 112, 114. A filter having any desired number of poles may be constructed by adding elements 112 or by subtracting elements 112 and 114. Illustrative examples of a single-pole filter 310, a double-pole filter 410, and two alternative embodiments 510 and 610 of a triple-pole filter are shown in FIGS. 3–6, respectively.

The geometries of resonator elements 112, 114 and gaps 118 are critical to the performance of filter 110. The center frequency of filter 110 is determined by the length of resonator elements 112, 114: the length of each resonator element 112, 114 is close to an integer multiple of one-half of the wavelength of the center frequency signals. The total width of resonator elements 112, 114 determines the impedance of filter 110. The coupling coefficient of resonator elements 112, 114 is determined by the width of gaps 118: the smaller are gaps 118, the higher is the coupling coefficient. The coupling coefficient is in turn determinative of the bandwidth of filter 110: the bandwidth is proportional to the product of the coupling coefficient and the center frequency of the filter. Significantly, the adjacent parallel portions of resonator elements 112, 114 provide additional coupling.

The spacing 120 between the side-by-side parallel portions of resonator elements 112, 114 determines the phase difference of the additional cross-spacing 120 coupling of resonator elements 112, 114 from the cross-gap 118 coupling of resonator elements 112, 114. The cross-spacing 120 coupling forms a notch 204 (see FIG. 2) in the passband of filter 110 and determines the position of notch 204: the smaller is the spacing 120, the higher is the frequency of notch 204.

Figure 2:
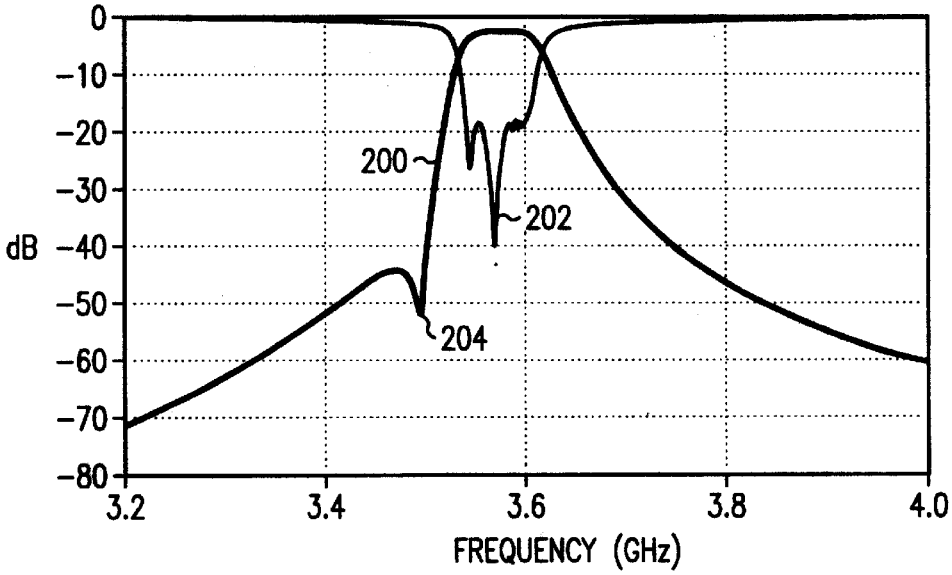
FIG. 2 is a graph of the performance characteristics of the planar filter of FIG. 1.
Figure 3:
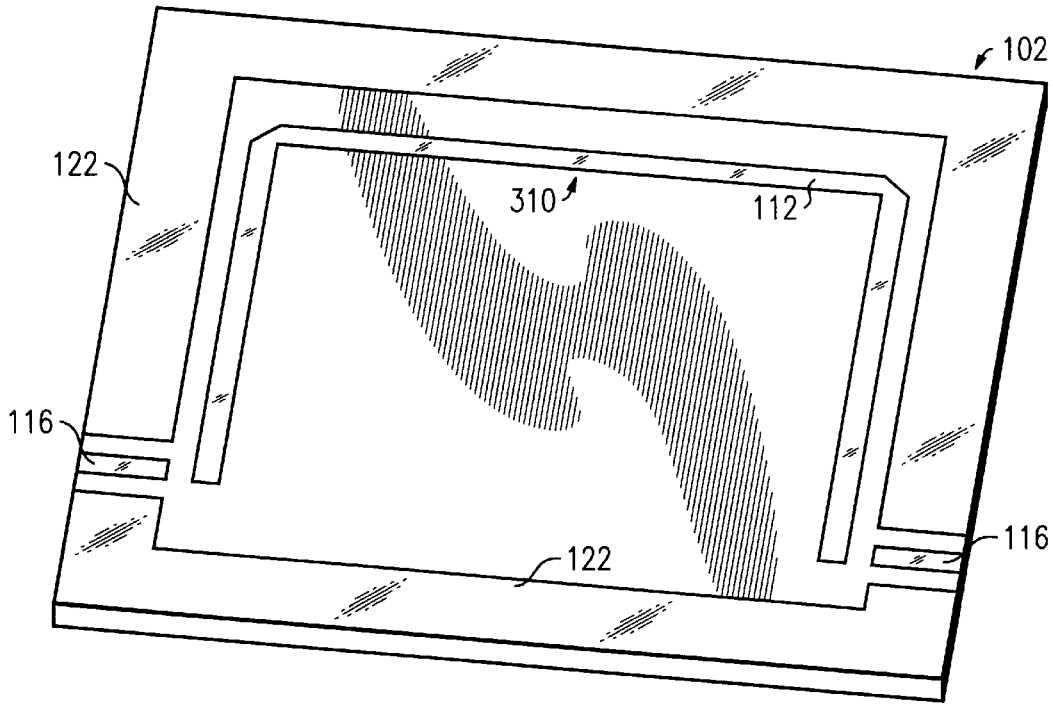
FIG. 3 is a perspective view of a single-pole planar filter constructed according to the invention.
Figure 4:
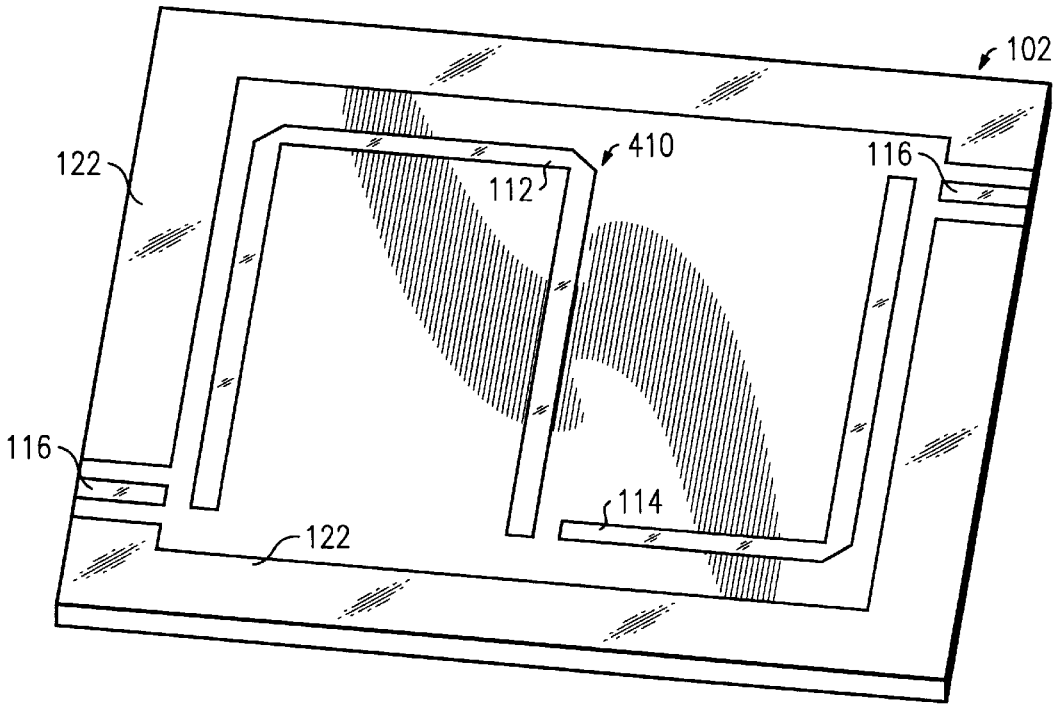
FIG. 4 is a perspective view of a double-pole planar filter constructed according to the invention.
Figure 5:
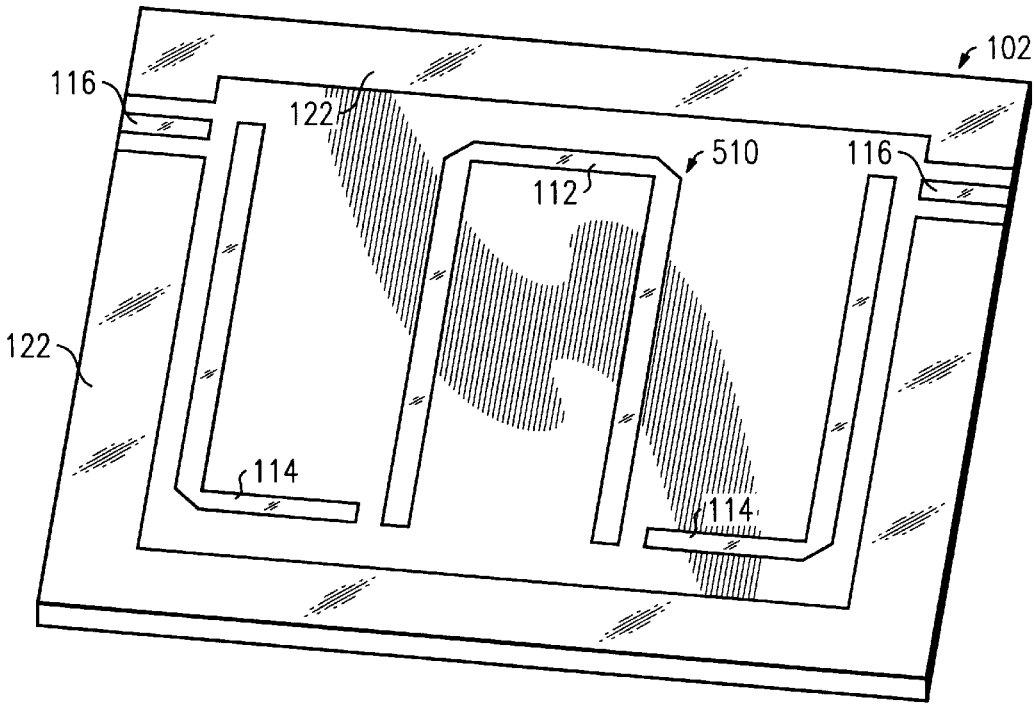
FIG. 5 is a perspective view of a first embodiment of a triple-pole planar filter constructed according to the invention.
Figure 6:
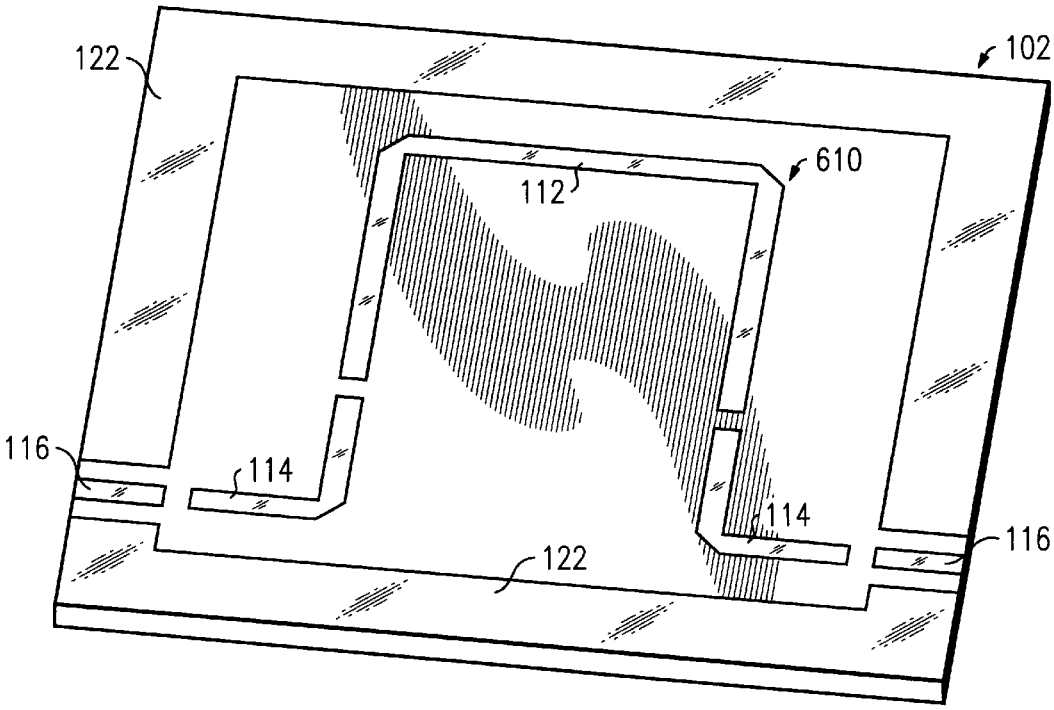
FIG. 6 is a perspective view of a second embodiment of a triple-pole planar filter constructed according to the invention.
Figure 7:
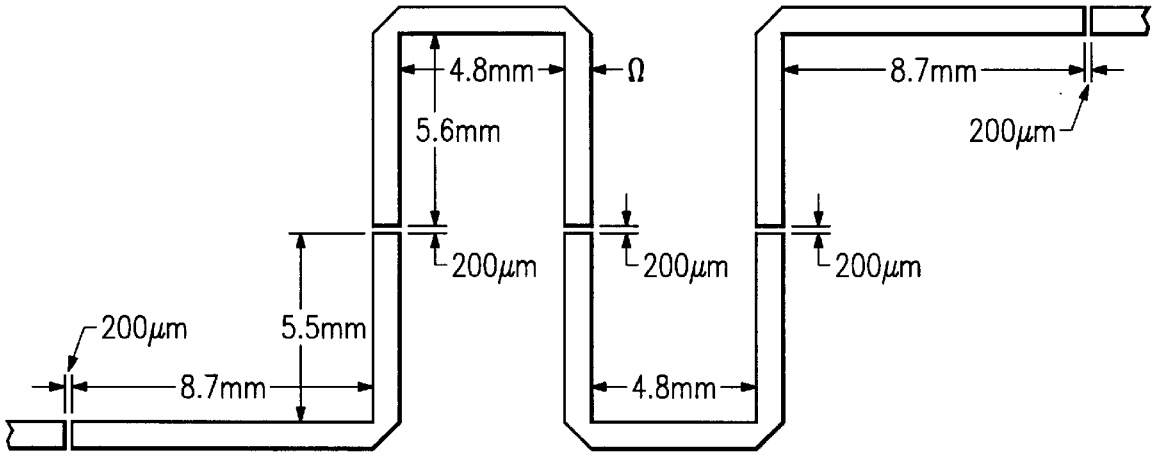
FIG. 7 shows dimensions of the planar filter of FIG. 1 that produce the performance characteristics of FIG. 2.

The exact geometry of a filter 100 having the desired characteristics is best determined by simulation. Commercial simulation programs like LIBRA from Hewlett-Packard or SONET from Sonet Inc. may be used. FIG. 2 shows the expected (simulated) characteristics of four-pole planar filter 110 of FIG. 1 having the dimensions shown in FIG. 7. Curve 200 shows the filter insertion loss and curve 202 shows the filter return loss. Notch 204 (a transmission zero) in insertion loss curve 200 is caused by the cross-spacing 120 coupling of resonant elements 112, 114.

Of course, various changes and modifications to the illustrative embodiment described above will be apparent to those skilled in the art. Such changes and modifications can be made without departing from the spirit and the scope of the invention and without diminishing its attendant advantages. It is therefore intended that such changes and modifications be covered by the following claims except insofar as limited by the prior art.

What is claimed is:

1. A method of tuning a filter of electrical signals comprising:

a signal input;

a signal output; and one or more resonator elements coupled serially end-to-end between the input and the output across gaps that separate the one or more elements from the input and the output and from each other, the one or more elements forming a serpentine shape such that at least two portions of the serpentine shape are positioned side-by-side parallel to each other, the method comprising varying a lateral spacing between the side-by-side parallel portions to inversely vary a frequency at which said spacing produces a notch increase in an insertion loss of the filter.

2. The method of claim 1 for a filter comprising a plurality of the resonator elements, wherein:

varying a lateral spacing comprises the step of varying the lateral spacing to vary a phase difference between a coupling across the lateral spacing of the resonator elements and a coupling across the gaps of the resonator elements.

* * * * *